United States Patent [19]

DeParales

[11] Patent Number: 4,738,373

[45] Date of Patent: Apr. 19, 1988

[54] CUP COVER HAVING OPENING MEANS

[76] Inventor: Lawrence T. DeParales, 1 Gates Rd., P.O. Box 483, Marshfield, Mass. 02050

[21] Appl. No.: 899,312

[22] Filed: Aug. 22, 1986

[51] Int. Cl.[4] ..... B65D 41/56

[52] U.S. Cl. ..... 220/254; 220/90.2; 220/90.4; 220/269

[58] Field of Search ..... 220/269, 270, 90.2, 220/90.4, 254, 268; 229/7 R

[56] References Cited

U.S. PATENT DOCUMENTS 4,629,088 12/1986 Durgin ..... 220/269

*Primary Examiner*—George T. Hall

*Attorney, Agent, or Firm*—Henry C. Nields

[57] ABSTRACT

A cover for a disposable drinking cup is provided. The cover has a hinged tab defined by score lines which is re-closable. A pair of spaced apart arcuate ribs is provided on the cover which forms an arcuate recess. The recess is designed to releasably engage the tab and retain it in an open position. A sump can also be included on the cover, which serves as a collection reservoir for any spilled liquid.

12 Claims, 2 Drawing Sheets

CUP COVER HAVING OPENING MEANS

FIELD OF THE INVENTION

This invention relates to an improved lid for a disposable drinking cup such as commonly used for coffee, said lid being of the type which has a tab formed in the lid which can be opened to allow drinking from the cup and re-closed to keep the remaining contents from spilling.

BACKGROUND OF THE INVENTION

Coffee and other beverages are often provided in disposable plastic or coated paper cups, with a lid frictionally retained on the cup to prevent spillage. Such lids are often provided with a tab which can be torn open to provide a drinking opening. Preferably said tab should be reclosable, to prevent spilling of the remaining contents of the cup. Such a tab is shown in U.S. Pat. No. 4,202,459 issued May 13, 1980, U.S. Pat. No. 4,113,135 issued Sept. 12, 1978, and U.S. Pat. No. 3,994,411 issued Nov. 30, 1976.

Such covers or lids have not been entirely satisfactory and are not widely used, possibly because the tab is not securely held in the open position, is not securely held in the closed position after being opened and closed, does not adequately seal the opening when closed after being opened, and often, on initial opening, the edges of the tab do not tear accurately along the intended line.

SUMMARY OF THE INVENTION

This invention provides a cover for a drinking cup which has a cavity around the lower side of the periphery for frictionally engaging the rim of the cup, in which the outer wall of the cavity is inclined inwardly to be spaced from the inner wall a distance such that the walls and frictionally grip the rim of the cup. A tab is formed in the cover by suitable score lines leading generally from the rim of the cover to a hinge positioned in the medial portion of the cover. A recess is provided in the cover, said recess being suitably spaced from and on the opposite side of the hinge from the rim portion of the tab to receive the rim portion when the tab is opened. The recess is formed by a pair of upwardly extending walls with the far wall being shaped to provide an undercut for receiving the outer wall of the portion of the rim cavity of the tab. The recess walls are suitably spaced to maintain the wall segments of the rim portion of the tab in their original spacing so that they can securely grip the rim of the cup when the tab is re-closed. In a preferred embodiment of the invention, the score lines forming the tab do not extend through the portion of the cover that extends over the rim of the cup, and ribs are formed on both sides of the score lines forming the tab, to stiffen the edges of the tab and the adjacent portion of the cover to minimize the possibility of leakage when the cover is re-closed, and to assist in guiding the tear line when the tab is first opened. In another embodiment of the invention the cover is provided with a sump on the side of the hinge opposite the tab, to collect inadvertently spilled coffee and return it to the cup when the cup is tilted for drinking.

DESCRIPTION OF THE ILLUSTRATED EMBODIMENT

Figure 1:
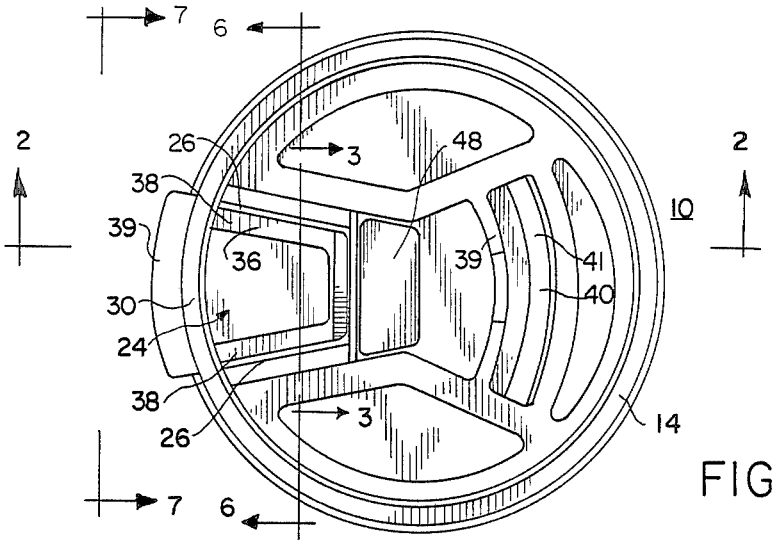
FIG. 1 is a top view of a cover embodying the features of the invention.
Figure 2:
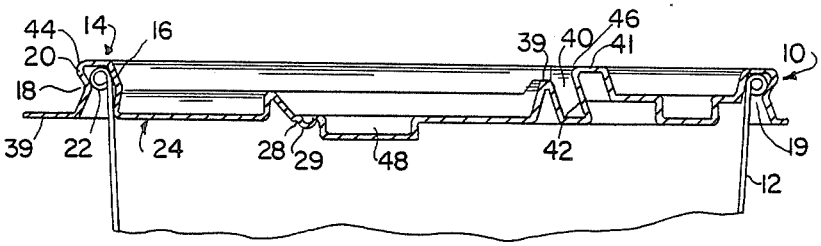
FIG. 2 is a view in section taken on line 2—2 of FIG. 1.
Figure 3:
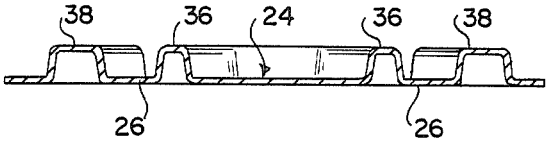
FIG. 3 is a view in section taken on line 3—3 of FIG. 1.

Referring to the drawing, there is illustrated a cover 10 which is particularly adapted for use in covering a disposable container 12 of the type used by so-called "take-out" food establishments.

The cover comprises generally a center portion bounded by a circular rim which is formed into a rib 14 by inner and outer upstanding walls 16, 18, with the upper portion 20 of the outer wall being inclined inwardly and being so spaced from the inner wall as to frictionally grip the enlarged rim 22 of the container.

Figure 4:
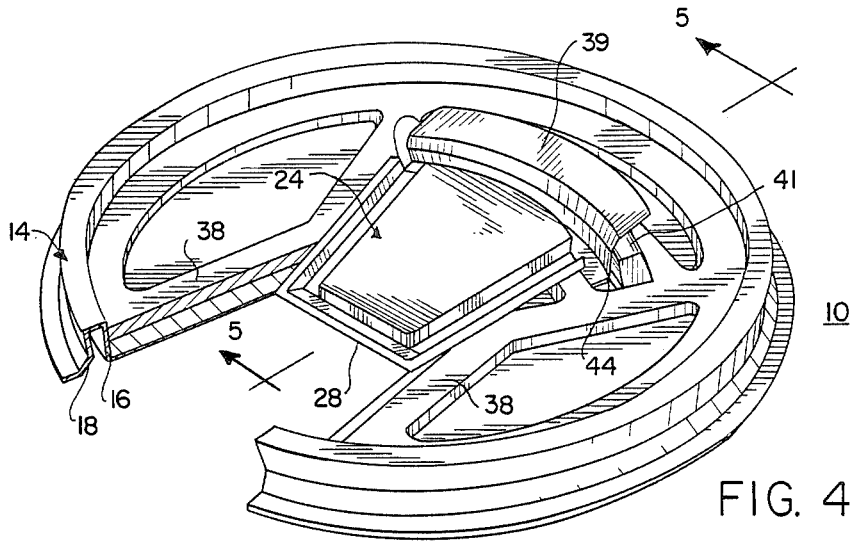
FIG. 4 is a perspective view of the cover with the tab on the open position.

A tab 24 is provided in the cover, said tab being bounded by score lines 26 forming the sides, a hinge 28 forming the permanent connection with the rest of the cover, and a portion 30 of the outer rib. A rib 29 is provided between the hinge and the remainder of the cover to provide stability to the hinge. The score lines 26 may be completely cut through the cover material, or may be merely lines of weakness. The score lines extend to the outer rib 14 and part way up the inner wall, and from the lower end 32 of the outer wall upwardly, but do not extend over the top portion 34 of the rib 14 for a purpose to appear hereinafter. (See FIG. 4.)

To reinforce the edges of the tab and the adjacent edges of the cover at the tab opening, reinforcing ribs 36 are provided along the side edges of the tab, and reinforcing ribs 38 are provided along the edges of the cover adjacent to the tab opening. The ribs are preferably all of the same height, to permit stacking of covered cups on top of each other.

The tab is intended to be opened by tearing along the score lines and bent back at the hinge to provide an opening from which the contents may be drunk, and to be re-closable to keep the remaining contents from leaking out. To facilitate opening, the tab has a radially extended portion 39 which projects outwardly beyond the adjacent portion of the outer wall 18.

Figure 6:
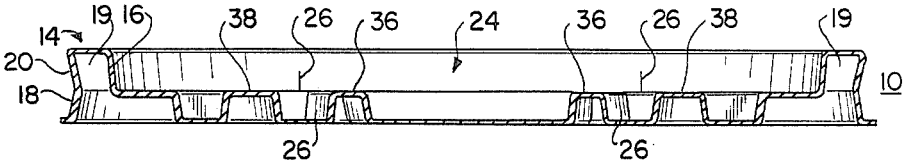
FIG. 6 is a view in section taken on line 6—6 of FIG. 1.
Figure 7:
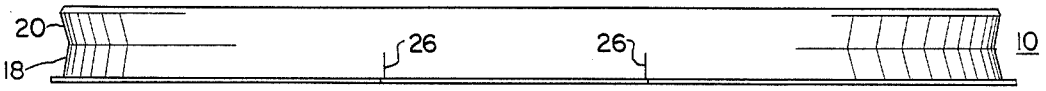
FIG. 7 is a view taken on line 7—7 of FIG. 1.
Figure 5:
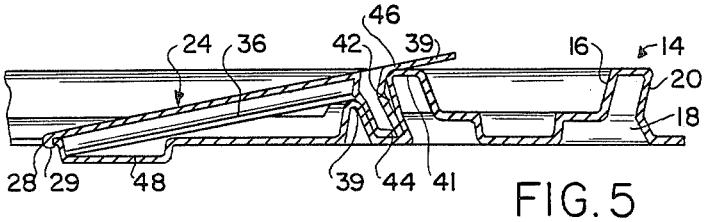
FIG. 5 is a view in section taken on line 5—5 of FIG. 4.

To retain the tab in the open position, a pair of spaced arcuate ribs 39 and 41 are provided in the cover on the side of the hinge opposite the tab, forming an arcuate recess 40. The ribs 39, 41, and the recess 40 have the same radius of curvature as that of the peripheral rib 14. The inner wall 42 of the rib 41 is inclined toward the hinge, forming an undercut for a purpose to be described. The wall 42 is spaced from the hinge a distance such that when the tab is opened and folded back about the hinge, the upper outer corner 44 of the portion of the rib 14 on the end of the tab snaps past the upper end 46 of the wall 42 of the recess 40 (see FIG. 6) to securely retain the tab in the open position, yet allowing the tab to be easily released from engagement in the recess 40 to enable it to be re-closed. The width of the recess 40 is such that when the portion of the peripheral recess 14 on the end of the tab is engaged theein, the walls of the rib 14 are held in substantially the same position as they were before assembly onto the cup, and are not allowed to spread apart due to the heat of the cup contents and "plastic memory" of the cover material. Therefore when the tab is re-closed, the walls of the portion of the rib 14 on the end of the tab can securely engage the rim of the cup.

Also provided in the cover 10 is a depressed portion or sump 48 on the side of the hinge opposite the tab. The sump 48 collects any liquid that is spilled onto the cover, either through the tab opening or from a cup stacked on top of the cover. The cover can be removed from the cup to empty the sump or the sump will empty automatically into the tab opening when the cup is tilted for drinking. When the cover is first placed on the cup, the cup rim is received in the peripheral recess 19 and is frictionally engaged by the walls 16, 18, to securely retain the cover on the cup. Before the tab is opened, the cover securely seals the cup against liquid leakage, with there being no danger of the tab opening accidentally, since the tab is not separated from the cover on the top portion 34 of the rib 14, even though it may be completely cut from the cover along the score lines 26 and at the lower portion of the outer wall.

When the tab is to be opened to allow drinking from the cup, it is torn along the score lines starting from the outer end of the outer wall 18, over the top of the rib 14, and along the lines disposed between the re-inforcing ribs 36, 38, to the hinge. During the opening of the tab, the reinforcing ribs 36 and 38 on and alongside the score lines insure that the tearing of the material follows the score lines between the ribs.

The tab may then be folded back at the hinge and snapped into engagement with the wall 42 of recess 40 as previously described.

When it is desired to re-close the cup, the tab is released from the recess 40, and pivoted back to its original position, with the portion of the walls 16, 18 of the rib 14 on the end of the tab again frictionally engaging the rim 22 of the cup. After such re-closing, the reinforcing ribs 36, 38, maintain the adjacent edges of the tab and the cover closely adjacent to each other to minimize the gap between said edges, to minimize the possibility of leakage through said gap of liquid remaining in the cup.

Although in the illustrated embodiment, the recess 40 has a length substantially the same as that of the width of the end of the tab, it will be understood that in some cases the means retaining the tab in the open position may be a pair of posts or the like with suitable shoulders for catching the portion of the outer wall 18 on the end of the tab, and for preventing the walls of the rib 14 from tending to open.

Since certain other changes obvious to one skilled in the art may be made in the illustrated embodiment of the invention, it is intended that all matter contained herein be interpreted in an illustrative and not a limiting sense.

I claim:

1. A cover for a drinking cup of the type having an upwardly projecting peripheral rib formed by spaced walls forming a peripheral cavity on the lower surface for receiving the rim of a cup, and a tab formed in the cover, said tab including a segment of the periphery of the cover and being hinged to the remainder of the cover at a medial portion thereof, whereby said tab may be opened by pivoting around the hinge to lie against the top of the cover, and spaced means positioned on the top of the cover to receive the portion of the upwardly projecting rib on the edge of the tab and retain the walls thereof in a spacing not greater than their original spacing before assembly onto the cover to enable the walls to securely grip the rim of the cup when the tab is closed.

2. A cover as set out in claim 1 in which said spaced means comprises spaced arcuate walls.

3. A cover as set out in claim 1 in which the outermost wall forming the peripheral rib is inclined inwardly toward the other wall, and said spaced means forms an undercut portion positioned to receive said outer wall in resilient engagement.

4. A cover for a drinking cup, said cover being of the type that has a tab which may be opened for providing a drinking opening, said tab being hinged to the remainder of the cup at a medial portion of the cover and extending to the periphery of the cover, the improvement comprising a sump adjacent to the position at which the tab is hinged to the cover for collecting liquid from the top of the cover, said sump being so positioned as to allow liquid from the sump to drain into the drinking opening when the cup is tilted for drinking therefrom.

5. A cover for a drinking cup of the type having a peripheral rib formed by inner and outer upwardly projecting peripheral walls forming a peripheral recess on the under side of the cover, the outer wall of the rib being inclined inwardly and being spaced from the inner wall to allow the walls to frictionally engage the rim of a cup, in which a tab is formed in the cover by score lines extending radially outwardly from a hinge portion connecting the tab to the remainder of the cover, the outer end of the tab including a segment of the peripheral rib, whereby said tab may be pivoted to an open position about said hinge portion, and latch means on the opposite side of the hinge from the tab positioned and dimensioned for cooperating with the inwardly inclined outer wall of the portion of the rib at the end of the tab to hold the tab in the open position, and for retaining the walls of the portion of the peripheral rib on the end of the tab in substantially their original spacing so as to enable them to securely engage the rim of the cup when the tab is re-closed.

6. A cover as set out in claim 5 in which said latch means has an undercut surface on the side facing the tab to receive the portion of the inwardly inclined outer wall on the end of the tab in snapping engagement.

7. A cover as set out in claim 6 in which said latch means is arcuate with the same radius of curvature as that of the outer wall of the peripheral rib.

8. A cover as set forth in claims 1 or 5, wherein the hinge is stabilized by means of a rib positioned between said hinge and the remainder of the cover.

9. A cover for a drinking cup of the type having a peripheral rib formed by inner and outer upwardly projecting peripheral walls forming a peripheral recess on the under side of the cover, the outer wall of the rib being inclined inwardly and being spaced from the inner wall to allow the walls to frictionally engage the rim of a cup, in which a tab is formed in the cover by score lines extending radially outwardly from a hinge portion connecting the tab to the remainder of the cover, the outer end of the tab including a segment of the peripheral rib, whereby said tab may be pivoted to an open position about said hinge portion, and latch means on the opposite side of the hinge from the tab positioned and dimensioned for cooperating with the inwardly inclined outer wall of the portion of the rib at the end of the tab to hold the tab in the open position, said latch means comprising a pair of spaced arcuate ribs greater in length than the portion of the rib at the end of the tab.

10. A cover as set out in claim 9 in which said latch means has an undercut surface on the side facing the tab to receive the portion of the inwardly inclined outer wall on the end of the tab in snapping engagement.

11. A cover as set out in claim 10 in which said latch means is arcuate with the same radius of curvature as that of the outer wall of the peripheral rib.

12. A cover as set out in claim 9 in which the latch means retains the walls of the portion of the peripheral rib on the end of the tab in substantially their original spacing so as to enable them to securely engage the rim of the cup when the tab is re-closed.

* * * * *